United States Patent [19]

Ford

[11] 4,071,101

[45] Jan. 31, 1978

[54] STABILIZER FOR SINGLE OR DUAL TUBE DRILLING

[75] Inventor: George Alan Ford, Houston, Tex.

[73] Assignee: Walker-Neer Mfg. Co., Inc., Wichita Falls, Tex.

[21] Appl. No.: 664,958

[22] Filed: Mar. 8, 1976

[51] Int. Cl.[2] ..... E21B 17/10

[52] U.S. Cl. ..... 175/325; 308/4 A

[58] Field of Search ..... 175/325, 215; 308/4 A

[56] References Cited

U.S. PATENT DOCUMENTS

| | | | |
|---|---|---|---|
| 790,330 | 5/1905 | Terry | 175/325 X |
| 2,072,320 | 3/1937 | Thomas | 308/4 A |
| 2,696,367 | 12/1954 | Robishaw | 175/325 X |
| 2,850,264 | 9/1958 | Grable | 175/215 X |
| 3,104,134 | 9/1963 | Nielsen et al. | 175/325 X |
| 3,109,501 | 11/1963 | Pugh | 175/325 |
| 3,208,539 | 9/1965 | Henderson | 175/215 |
| 3,400,773 | 9/1968 | Tiraspolsky et al. | 175/325 |
| 3,503,461 | 3/1970 | Shirley | 175/325 |

*Primary Examiner*—Ernest R. Purser
*Assistant Examiner*—Richard E. Favreau
*Attorney, Agent, or Firm*—Hume, Clement, Brinks, Willian & Olds, Ltd.

[57] ABSTRACT

A stabilizer for use with a string of single tube or dual concentric drill pipe above a bit having analogous tubular members adapted for fluid tight interconnection with the pipes of said string to provide a conduit for drilling fluid. A stabilizer means encircles the stabilizer body and is adapted to contact the hole wall. The stabilizer means includes a sleeve bearing mounted to rotate with respect to the stabilizer body and a stabilizer sleeve mounted stationary on the sleeve bearing. A port means in the stabilizer body provides fluid communication between the drilling fluid conduit and the stabilizer sleeve and/or thrust bearing. An exit port means in the lower end of the stabilizer means provides fluid communication between the stabilizer sleeve bearing and the outside of the stabilizer.

8 Claims, 4 Drawing Figures

STABILIZER FOR SINGLE OR DUAL TUBE DRILLING

BACKGROUND OF THE INVENTION

Single tube drilling assemblies and multi-tube concentric drilling assemblies are both accepted equipment for conventional fluid injection drilling. Additionally, multi-tube concentric drilling assemblies are utilized in reverse circulation drilling. A system for dual tube drilling is disclosed in Henderson, U.S. Pat. No. 3,208,539.

In conventional drilling, utilizing single tube drilling assemblies, drilling fluid (e.g., mud or water) is pumped down the drill pipe to the bit or tool and returns to the surface through the annular space between the drill pipe and the hole wall (the hole annulus). Conventional circulation utilizing multi-tube concentric drilling assemblies allows the fluid to be circulated down either or both the inner tube passage and the pipe annulus (the passage between an outer and inner tube disposed concentrically), across the cutting face of the tool and returned to the surface through the hole annulus. This latter mode may be used to keep two fluids separated until they are at or near the bottom of the hole, where they would be mixed, possibly forming a third substance with different characteristics, such as a stiff foam, gel, liquid or solid having the particular chemical or physical properties needed at or near the point of mixing.

In reverse circulation dual tube drilling systems, the drilling fluid is pumped down to the bit through the pipe annulus to the site of the bit. The fluid returns to the surface through the inner pipe.

It is important to rotary drill systems generally, of which the above described are examples, to provide additional lateral support to the drill stem to limit buckling of such portions which may be subject to compression, or to maintain borehole alignment. Such lateral support can be provided by borehole devices generally known as stabilizers.

The majority of stabilizers in general use are equipped with diameter control blades or wear pads which rotate with the drill stem and are therefore subject to circumferential surface wear by the formation being drilled. Also the blades or wear pads of such tools tend to cut into the walls or under-ream the borehole in which they are employed.

Other types of stabilizers are equipped with non-rotating blades or wear pads which are mounted on a sleeve and do not rotate with respect to the hole wall. These devices have the disadvantage of rapid wear between the non-rotating stabilizer sleeve and the rotating stem or mandrel which wear is also increased by the entry and accumulation of abrasive particles between these surfaces from the circulating fluid as it ascends from the bit or cutting head.

SUMMARY OF THE INVENTION

The present invention provides an improved stabilizer for use with a string of dual concentric drill pipe including a non-rotating stabilizer sleeve. The present invention further provides an improved non-rotating stabilizer for single tube and multi-tube concentric drilling assemblies. The present invention also provides a means for preventing rapid wear between the sleeve bearings of a stabilizer and the rotating stabilizer body and for preventing entry and accumulation of abrasive particles between the adjacent surfaces of these components from the cutting return fluid stream. The present invention further provides a means for providing lateral support for a rotary drill stem which overcomes the disadvantages of the prior art non-rotating stabilizer devices. This is achieved by providing a stabilizer means with stabilizer sleeve, which may include a cylindrical core and arm members, mounted on a sleeve bearing which in turn is mounted on a section of the cylindrical body of the stabilizer. The stabilizer sleeve and bearing are arranged to rotate with respect to the drill stem, so that as the drill string and stabilizer body rotate, the stabilizer sleeve remains stationary with respect to the hole wall. In one embodiment of the present invention fluid communications are provided between the stabilizer sleeve bearing and/or thrust bearing and the pipe annulus of a multi-tube assembly or the tubular conduit of a single tube assembly, which permits drilling fluid to flow to the thrust bearing and sleeve bearing. The constant flow of drilling fluid cools, flushes and lubricates the working surfaces of the stabilizer means and prevents entry and accumulation of abrasive particles between the surfaces of the stabilizer body and sleeve bearing. A further embodiment of the present invention provides a stabilizer for multi-tube concentric drilling assemblies including a non-rotating stabilizer sleeve and means for expansion of stabilizer.

The present invention may be used with any type of drilling fluid (e.g. water, drilling mud, air, gas). The stabilizer can be adapted to both conventional fluid injection or multi-tube concentric drill assemblies.

The general object of the invention is to provide an improved stabilizer for drilling assemblies. A further object is to provide a non-rotating drilling stem stabilizer which may include port means such as flow nozzles which utilize small amounts of clean drilling fluid to cool, lubricate and clean the working surfaces of the stabilizer means and prevent entry and accumulation of particles from the returning fluid stream. Other objects of the invention will become apparent upon consideration of the following description, with reference to the appended drawings, in which.

DESCRIPTION

Figure 1:
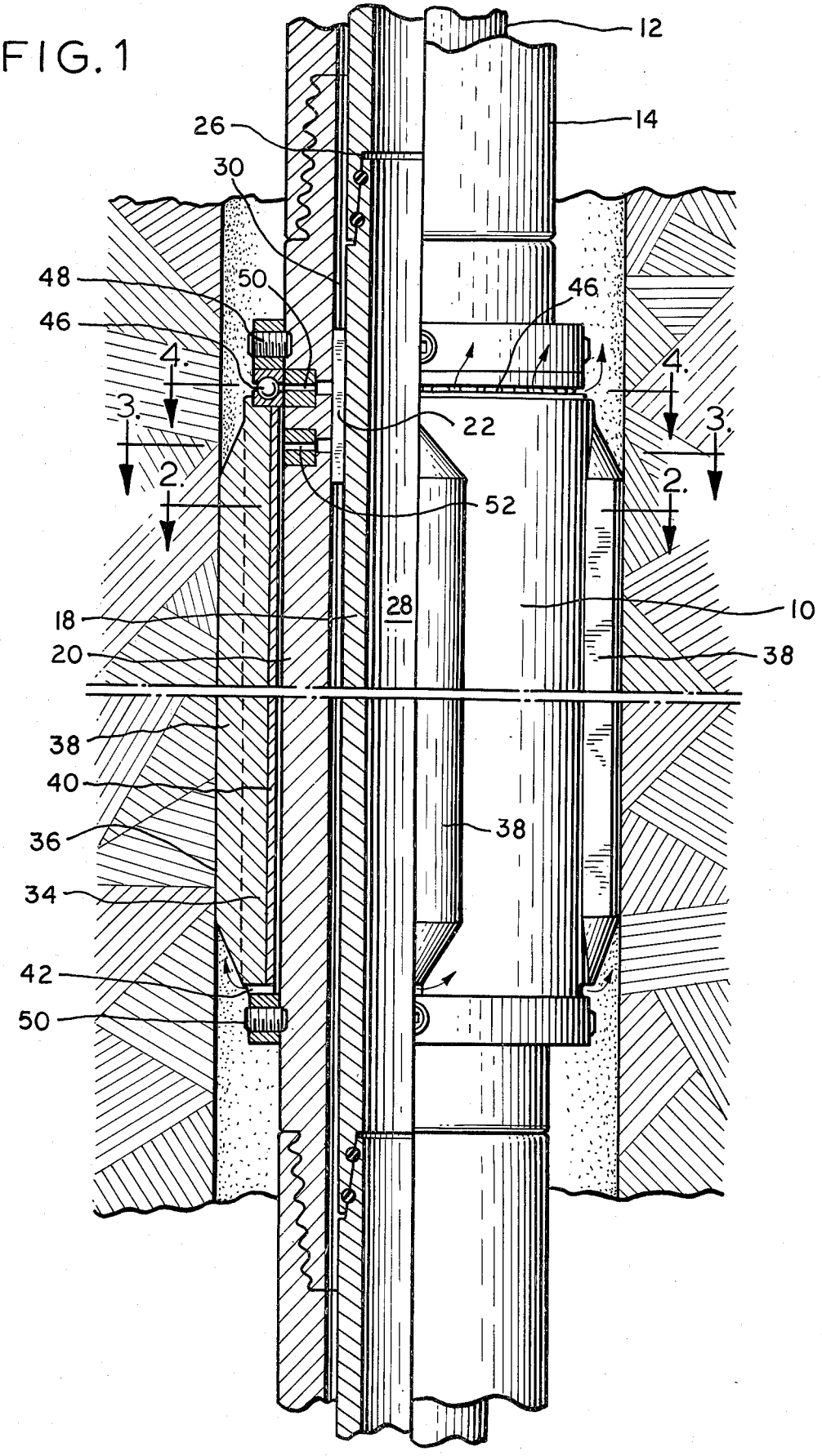
FIG. 1 is a transverse sectional view of a multi-tube concentric drilling string stabilizer embodying the present invention.
Figure 2:
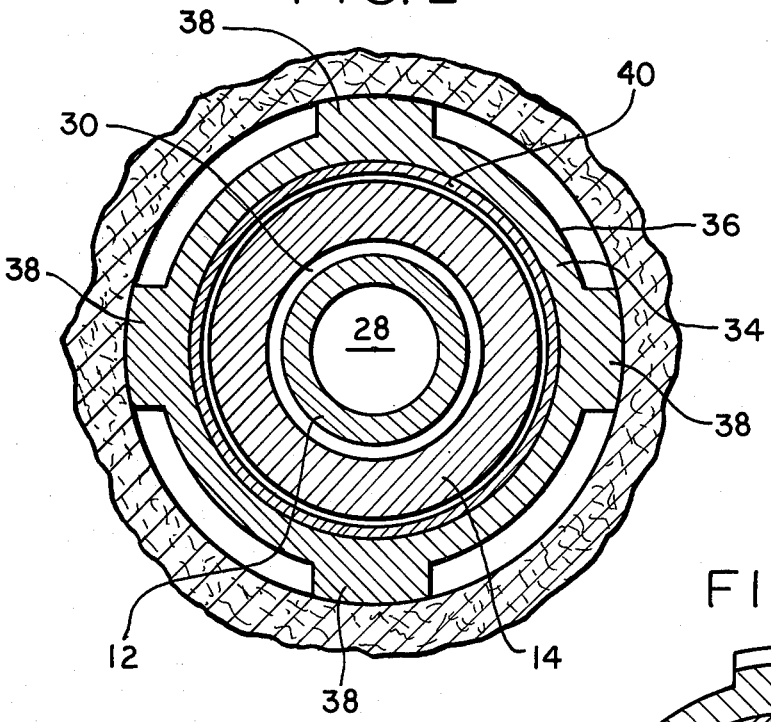
FIG. 2 is a cross section view taken on the line 2—2 of FIG. 1.
Figure 3:
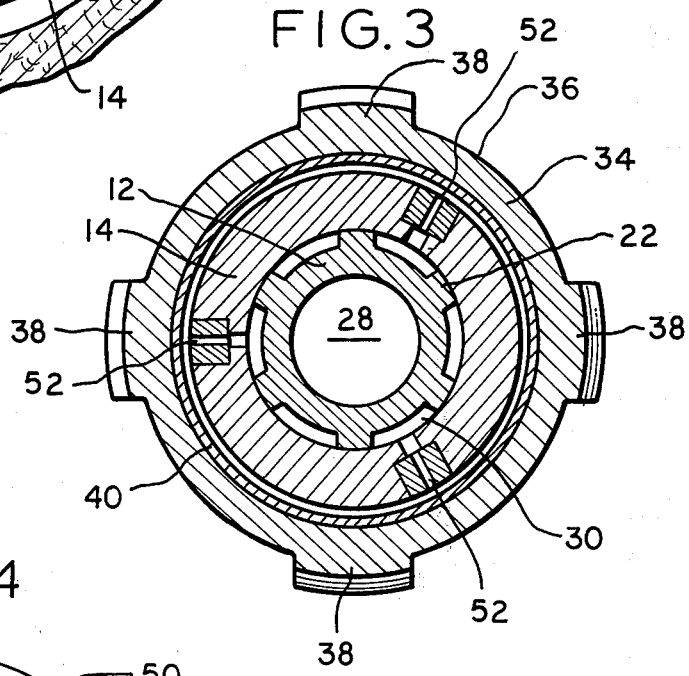
FIG. 3 is a cross section view taken on the line 3—3 of FIG. 1.
Figure 4:
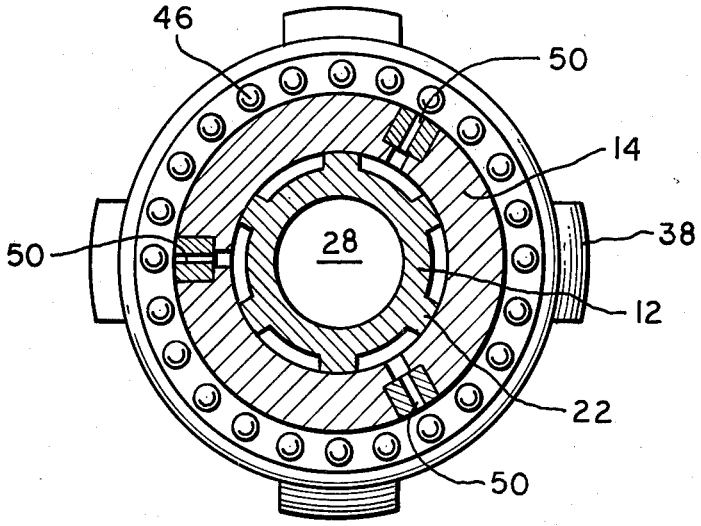
FIG. 4 is a cross section view taken on the line 4—4 of FIG. 1.

With reference to the drawings, there is shown in FIG. 1, as an example of one form in which the present invention may be embodied, a multi-tube concentric stabilizer designated generally by the numeral 10. The stabilizer 10 is adapted at both ends for interconnection with a string of dual tube concentric drill pipe having an inner pipe 12 and an outer pipe 14. The concentrically disposed inner and outer pipes form an annular conduit 30 separated from the flow path through the inner pipe. The stabilizer includes an inner tubular member 18 concentrically disposed with an outer tubular member 20 which tubular members are adapted for fluid-tight interconnection with said pipes of the drill string. The outer tube 20 of the stabilizer 10 is connected at each end to the outer tubes 14 of the drill string in a familiar fashion, as by a threaded pipe joint 34. The inner tubular member 18 of the stabilizer 10 communicates at each end of the inner tubes 12 of the drill string. In this manner, the annular passageway or first flow path 30 and the central passageway or second flow path 28 are maintained without interruption. During reverse circulation drilling, the drilling fluid travels from surface to the site of the bit (not shown) through the annular passageway and returns to the surface through the central passageway.

The tubular members 18 and 20 are maintained in concentric position by a spider or lugs 22. The inner and outer members 18 are preferably attached together at one point only (as by the lugs 22), or along only a limited portion of their length, or otherwise include means to accomodate relative expansion or contraction of the two members, as disclosed in Henderson U.S. Pat. No. 3,209,539.

The inner pipe 12 of the drill string mates telescopically with the upper end of the inner tubular member 18, and O-rings or other appropriate means are employed to provide a fluid-tight seal. A gap or groove 26 is preferably provided to accomodate a limited degree of axial movement of the members 12 and 18, also as disclosed in Henderson U.S. Pat. No. 3,208,539.

As can be seen, the respective interconnection of the tubular members 18 and 20 with the pipes 12 and 14 provide a continuous inner or central conduit 28 and a continuous annular conduit 30. Thus drilling fluid passes from the surface down through the pipe annulus 30, and eventually down to the site of the bit (not shown). The fluid provides cooling and lubricating for the cutting process and then passes upwardly to the surface through the central conduit or passageway 28. In this manner, the entrained cuttings are carried to the surface through the interior of the pipe 12. The stabilizer provides analogous conduits interconnected with the drilling string pipes forming a section of the first and second flow paths.

A stabilizing means, generally designated by the numeral 36, encircles the outer tubular member 20. The stabilizing means 36, includes a stabilizer sleeve 34, which has a series of arm members such as blades or wear pad members 38, and a stabilizer sleeve bearing 40. The sleeve bearing is mounted stationary on the cylindrical body of the stabilizer, designated member 20, for example on the outer surface of the outer tubular member 14. The stabilizer sleeve 36 is mounted on the sleeve bearing 40.

There is sufficient clearance space between the sleeve bearing 40 and the member 20 to permit the stabilizing means 36 to rotate with respect to the member 20. Thus as the drill string rotates within the hole, the stabilizing means 36 is held stationary with respect to the hole by means of frictional contact between blades or wear pads 38 and the hole wall.

At the upper end of the stabilizing means 36 a thrust bearing is provided, for rotational bearing against an upper lock collar 48. The upper lock collar 48 is mounted stationary with respect to the outer pipe 14 and the outer tubular member 20 and rotates therewith. Cooling, flushing and lubrication for the thrust bearing 46, as shown, is provided by a flushing nozzle or port means 50 which permits clean drilling fluid to flow from the annular conduit 30 to the bearing 46. In like manner, cooling, flushing and lubrication for the sleeve 40 is shown provided by means of flushing nozzle or port means, 52 which similarly permit drilling fluid to pass from the annular conduit 30 to the clearance space between the sleeve 40 and the tubular member 20.

Below the lower end of the stabilizing means a lower lock collar 50 is mounted stationary with respect to the outer pipe 14 and the member 20 and rotates therewith.

Between the lower lock collar 50 and the lower end of the stabilizing means, a series of sleeve flush exit ports 42 are provided which permit the drilling fluid in the clearance space between the sleeve 40 the tubular member 20 to exit, flowing into the space between the hole wall and the drilling string.

It should be understood that the stabilizer means 36 need not take the form shown in the drawings. Any structure which is generally circular in cross section and includes a blade or wear pad member to contact the hole wall to provide an adequate support may be employed.

It should be understood that the stabilizer means of the present invention may be adapted for use with virtually any type of drilling string and sub, in addition to the dual tube concentric drill pipe assembly illustrated in the drawings. For example, the stabilizer means shown in FIG. 1 could be used in conjunction with a single tube drilling string for conventional fluid injection.

I claim:

1. A stabilizer for use with a string of dual concentric drill pipe above a tool, comprising:

an inner tubular member adapted for fluid-tight interconnection with the inner pipe of said string to provide a conduit for drilling fluid and cuttings from tool to surface;

an outer tubular member arranged concentrically with said inner member and adapted for fluid-tight interconnection with the outer pipe of said string to provide an annular conduit for drilling fluid from surface to tool;

a stabilizer means encircling said outer member and adapted to contact the hole wall, said stabilizer means including a sleeve bearing mounted to rotate with respect to said outer member and a stabilizer sleeve mounted stationary on said sleeve bearing, said outer tubular member and sleeve bearing forming a clearance space between their adjacent surfaces;

a port means in said outer tubular member providing fluid communication between said annular conduit and said clearance space; and an exit port means in the lower end of the stabilizer means providing fluid communication between said clearance space and the outside of the stabilizer.

2. A stabilizer in accordance with claim 1, including a thrust bearing above the upper end of the stabilizer means;

an upper lock collar mounted stationary with respect to said outer tubular member and positioned such that said thrust bearing rotates against said upper lock collar; and a second port means in said outer tubular member providing fluid communication between the annular conduit and said thrust bearing.

3. A stabilizer for use with a string of dual concentric drill pipe above a bit including an inner and outer pipe positioned concentrically to form an annular conduit and central conduit, comprising:

a cylindrical body;

a first passageway in said body communicating with the annular conduit between the inner and outer pipes of said string to provide a first flow path from surface to bit;

a second passageway in said body communicating with the central conduit of the inner pipe of said string to provide a second flow path isolated from said first flow path, to permit cuttings to be carried from the bit vicinity to surface;

a sleeve bearing encircling said cylindrical body and mounted on said body and forming clearance space between the adjacent surface of the cylindrical body;

a stabilizer sleeve mounted stationary on said sleeve bearing;

a thrust bearing above the upper end of said stabilizer sleeve and sleeve bearing;

a first series of flushing nozzles in said cylindrical body fluid connection between said first passageway and the surface of said sleeve bearing;

a second series of flushing nozzles in said cylindrical body providing fluid connection between said first passageway and said thrust bearing; and a series of exit ports in the lower end of the stabilizer sleeve and sleeve bearing providing fluid communication between the clearance space between the sleeve bearing and cylindrical body and the outer surface of said stabilizer.

4. A stabilizer for use with a string of single tube drill pipe above a bit, comprising;

a cylindrical body;

a passageway in said body communicating with the conduit of the pipe of the string to provide a flow path from surface to bit;

a sleeve bearing encircling said cylindrical body and mounted to rotate with respect to said cylindrical body said stabilizer sleeve bearing and cylindrical body forming a clearance space between their adjacent surfaces;

a stabilizer sleeve mounted stationary on said sleeve bearing;

a thrust bearing above the upper end of said stabilizer sleeve and sleeve bearing;

a first port means in said cylindrical body providing fluid connection between said passageway in the cylindrical body and the clearance space between said sleeve bearing and said cylindrical body;

a second port means in said cylindrical body providing fluid connection between said passageway in the cylindrical body and said thrust bearing; and an exit port means in the lower end of the stabilizer sleeve and sleeve bearing providing fluid connection between the clearance space between said sleeve bearing and said stabilizer body and the exterior of the stabilizer.

5. A stabilizer for use with a string of dual concentric drill pipe above a bit including an inner and outer pipe positioned concentrically, comprising:

an outer tubular member threaded at each end for engagement with correspondingly threaded ends of outer pipes of two engaging segments of said string;

an inner tubular member disposed concentrically within said outer member and adapted at one end for telescopic interconnection with the inner pipe of the other of said segments of said string so as to permit a limited degree of relative axial movement therebetween, the other end of said inner member being adapted for interconnection with the other engaging inner pipe in coaxial alignment therewith to form a continuous fluid conduit through said inner member and inner pipes;

an annular chamber defined between the outer surface of said inner member and the inner surface of said outer member, said inner and outer members being connected at one point along their length;

a stabilizer means encircling said outer member and adapted to contact the hole wall, said stabilizer means being mounted so as to rotate with respect to said outer member; said outer tubular member and stabilizer means forming a clearance space between their adjacent surfaces; and a port means in said outer tubular member providing fluid communication between said annular chamber and said clearance space.

6. A stabilizer for use with a string of dual concentric drill pipe above a bit including an inner and outer pipe positioned concentrically, conprising:

an outer tubular member threaded at each end for engagement with correspondingly threaded ends of outer pipes of two engaging segments of said string;

an inner tubular member disposed concentrically within said outer member and adapted at one end for telescopic interconnection with the inner pipe of the other of said segments of said string so as to permit a limited degree of relative axial movement therebetween, the other end of said inner member being adapted for interconnection with the other engaging inner pipe in coaxial alignment therewith to form a continuous fluid conduit through said inner member and inner pipes;

an annular chamber defined between the outer surface of said inner member and the inner surface of said outer member, said inner and outer members being connected at one point along their length; and a stabilizer means encircling said outer member and adapted to contact the hole wall, said stabilizer means including a sleeve bearing encircling said outer tubular member and mounted to rotate with respect to the outer member and a stabilizer sleeve mounted stationary on said sleeve bearing.

7. A stabilizer in accordance with claim 6 wherein said stabilizer sleeve includes;

a cylindrical core and arm members extending outward which arm members are adapted to contact the hole wall.

8. A stabilizer in accordance with claim 7 further including a thrust bearing mounted above said stabilizer means.

* * * * *